US007077789B1

(12) United States Patent
Chen

(10) Patent No.: US 7,077,789 B1
(45) Date of Patent: Jul. 18, 2006

(54) ADJUSTABLE MAGNETIC RESISTANCE MECHANISM FOR UPRIGHT BIKES

(75) Inventor: Ming Nan Chen, Taichung (TW)

(73) Assignee: Michael Lin, Taipei (TW)

( * ) Notice: Subject to any disclaimer, the term of this patent is extended or adjusted under 35 U.S.C. 154(b) by 0 days.

(21) Appl. No.: 11/127,410

(22) Filed: May 11, 2005

(51) Int. Cl.
*A63B 22/06* (2006.01)

(52) U.S. Cl. ..... 482/63

(58) Field of Classification Search ..... 482/51, 482/57, 60–65; 188/24.11–24.14, 24.19
See application file for complete search history.

(56) References Cited

U.S. PATENT DOCUMENTS 3,831,942 A * 8/1974 Del Mar ..... 482/72
5,031,901 A * 7/1991 Saarinen ..... 482/63
5,094,447 A * 3/1992 Wang ..... 482/63
5,310,392 A * 5/1994 Lo ..... 482/63
5,466,203 A * 11/1995 Chen ..... 482/63
6,095,953 A * 8/2000 Lee et al. ..... 482/57
6,569,063 B1 * 5/2003 Chen ..... 482/63
6,626,804 B1 * 9/2003 Wang et al. ..... 482/63

* cited by examiner

*Primary Examiner*—Stephen R. Crow
*Assistant Examiner*—Tam Nguyen
(74) *Attorney, Agent, or Firm*—Charles E. Baxley

(57) ABSTRACT

An adjustable magnetic resistance mechanism of an upright bike includes a fan-shaped adjustment board which is pivotably connected to the bike's frame and a magnet unit is connected to a distal end of the adjustment board. A connection board is connected to the adjustment board and a shaft of the flywheel extends through a curve slot of the adjustment board. Two ends of the shaft are supported on two support plates on two upright posts of the upright bike. An axle extends through a pivot hole in the adjustment board and the connection board. A resilient member is connected between the connection board and the adjustment board. The adjustment board is pivoted about the axle to adjust the gap between the flywheel and the magnet unit on the adjustment board.

4 Claims, 6 Drawing Sheets

ADJUSTABLE MAGNETIC RESISTANCE MECHANISM FOR UPRIGHT BIKES

FIELD OF THE INVENTION

The present invention relates to an adjustable magnetic resistance device and a flywheel, both of which are connected to an adjustment board by two individual shaft and axle so that the gap between the magnetic resistance device and the flywheel is conveniently adjusted.

BACKGROUND OF THE INVENTION

A conventional upright bike with magnetic resistance device is shown in FIG. 1 and generally includes two upright posts 3 on a horizontal base 3 of the bike and a flywheel 1 is installed between the two upright posts 3 by a frame 2. A magnetic resistance device 4 is connected above the horizontal base 3 by a support frame 5 and a proper gap is defined between the magnetic resistance device 4 and the flywheel 1 so as to generate a desired resistance to the flywheel 1. The gap has to be checked by professional persons after the magnetic resistance device 4 and the flywheel 1 are installed. In other words, after the upright bikes are assembled form the production lines, special persons are then adjust the gap of each upright bike one by one, and this is a time-consuming job.

Besides, during producing the frames of the bikes, holes for receiving shaft of flywheel might not be drilled at the desired positions and the support frame 5 or frame 2 might not be welded at correct position, so that the gap between the magnetic resistance device and the flywheel can be too far to adjust.

The present invention intends to provide a magnetic resistance upright bike wherein the magnetic resistance device and the flywheel are connected to an adjustment board by two individual shaft and axle so that the gap between the magnetic resistance device and the flywheel is kept in an adjusted range.

SUMMARY OF THE INVENTION

The present invention relates to an adjustable magnetic resistance mechanism for an upright bike, and the mechanism comprises a flywheel flywheel with a shaft extending through a center of the flywheel. A magnetic resistance device includes an adjustment board and a magnet unit, wherein the adjustment board has a curve slot defined therethrough. A connection device has a connection board which is connected to the adjustment board. The shaft extends through the curve slot and a first hole in the connection board. An axle extends through a pivot hole in the adjustment board and a second hole in the connection board. Two ends of the shaft is supported on two support plates which are connected to two upright posts of the upright bike. A resilient member is connected between the connection board and the adjustment board.

The primary object of the present invention is to provide a magnetic resistance mechanism wherein the gap between the magnet unit and the flywheel is easily to be adjusted.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
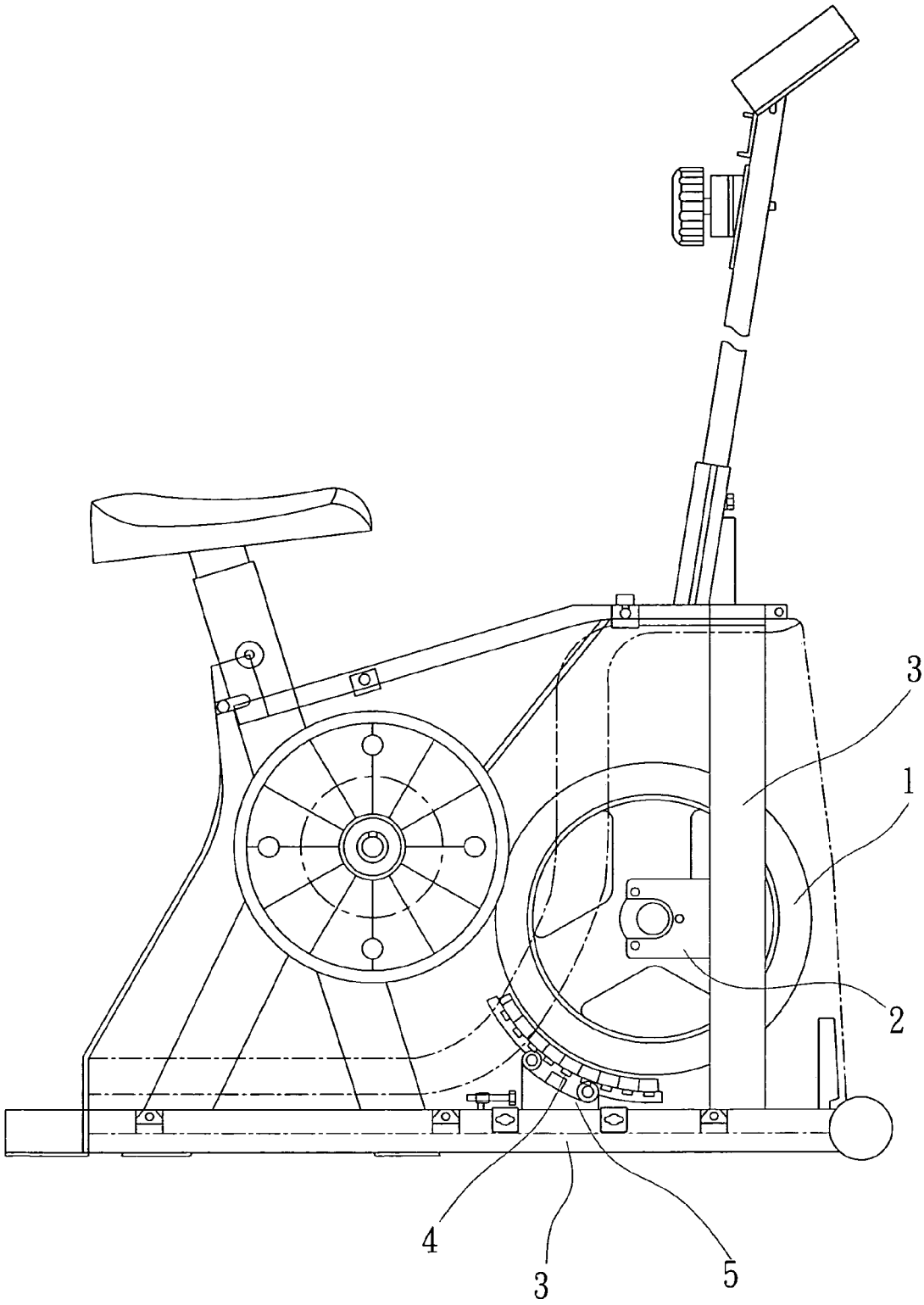
FIG. 1 PRIOR ART
FIG. 1 is a side view to show a conventional magnetic resistance upright bike.
Figure 2:
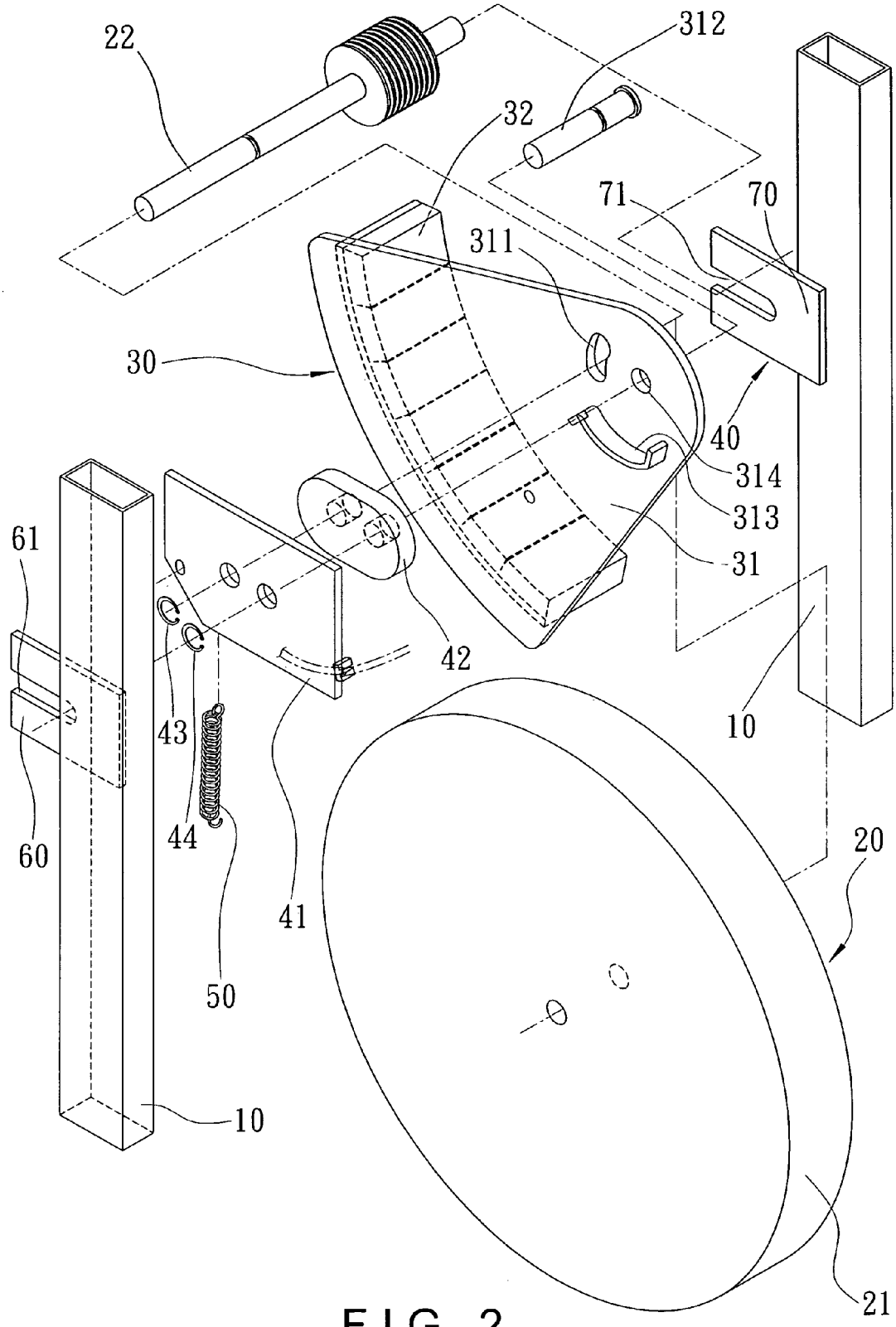
FIG. 2 is an exploded view to show the magnetic resistance mechanism of the present invention.
Figure 3:
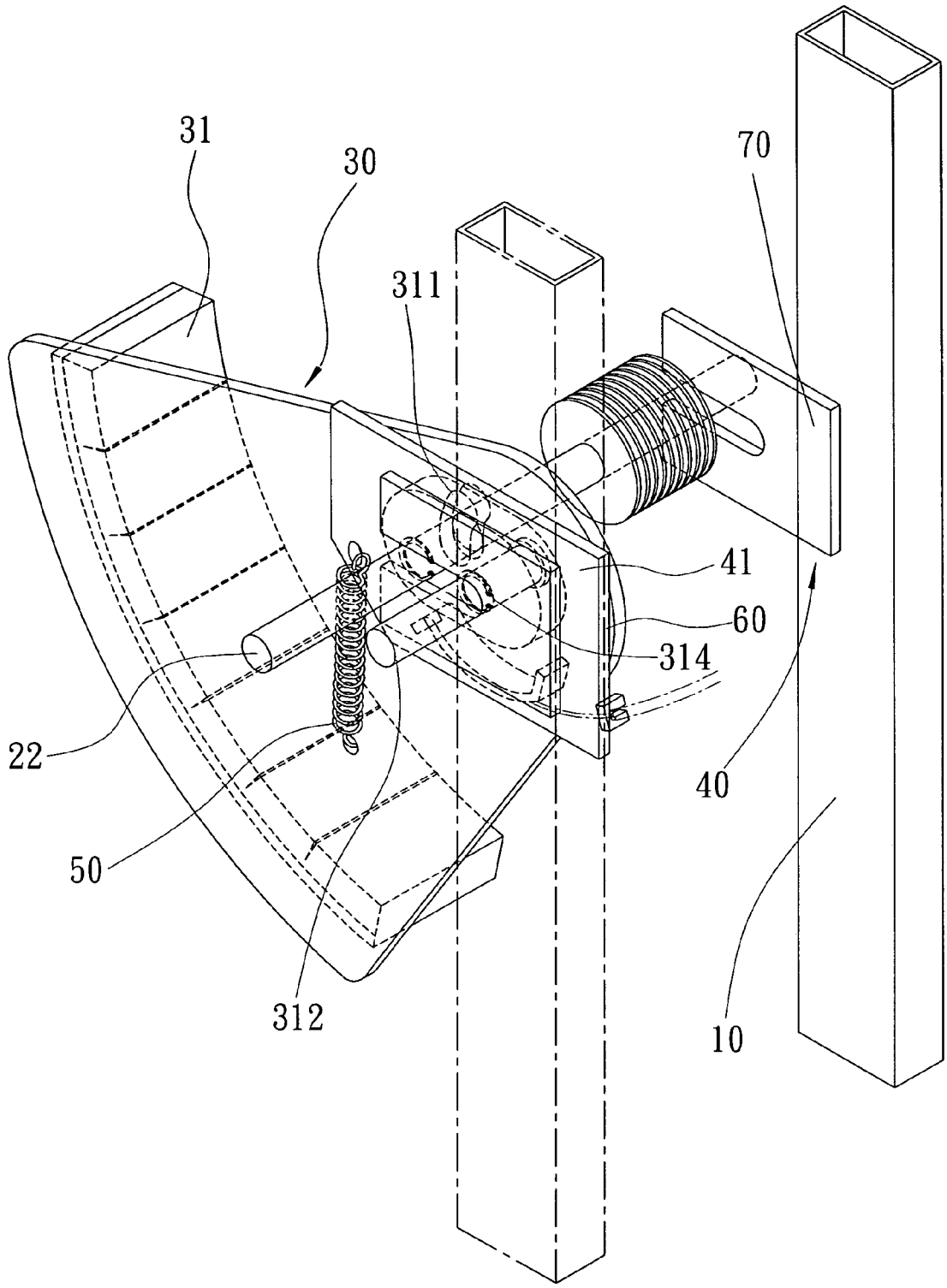
FIG. 3 is a perspective view to show the magnetic resistance mechanism of the present invention.
Figure 4:
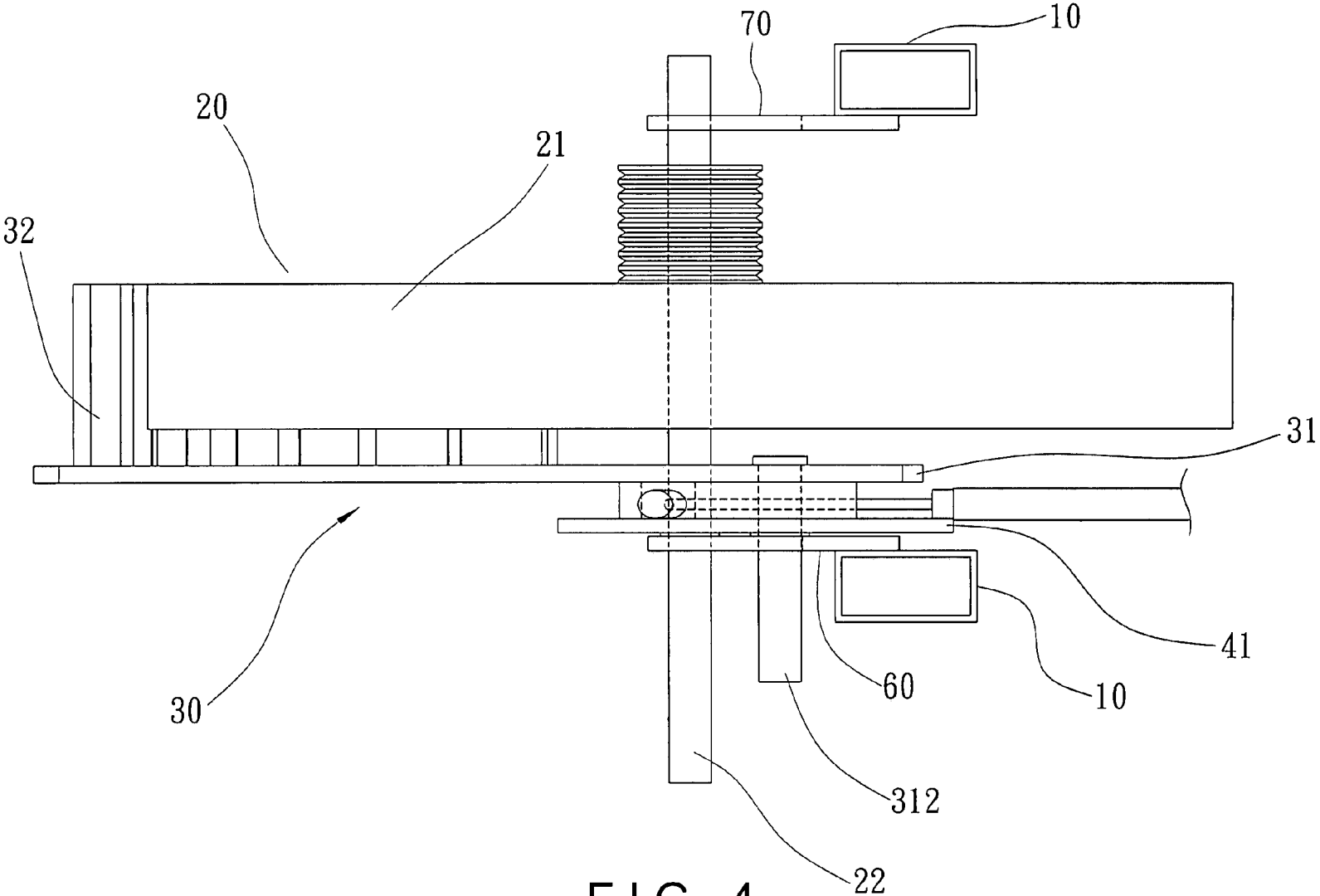
FIG. 4 shows a top view of the magnetic resistance mechanism of the present invention.

Referring to FIGS. 2, 3, 4, 5 and 7, the magnetic resistance upright bike of the present invention comprises a bicycle frame including two upright posts 10 between which a flywheel 21 is rotatably connected. A handle 13 is connected to a top of a handle post and a seat 11 is connected to a seat post. A driving wheel which can be rotated by operating a crank to which two pedals 12 are connected. A user can sit on the seat 11 and rotate the crank to rotate the flywheel 21. An adjustable magnetic resistance mechanism includes a flywheel assembly 20 and a magnetic resistance device 30. The flywheel assembly 20 includes the flywheel 21 and a shaft 22 extends through a center of the flywheel 21. Two ends of the shaft 22 are supported in two respective horizontal slots 61, 71 of two support plates 60, 70 which are connected to two upright posts 10 of the upright bike.

The magnetic resistance device 30 includes an adjustment board 31 and a magnet unit 32 which includes a plurality of magnets. The adjustment board 31 is a fan-shaped board and the magnet unit 32 is connected to a distal end of the fan-shaped board. A curve slot 311 and a pivot hole 314 are respectively defined through the adjustment board 31. The shaft 22 extends through the curve slot 311. A wire connection member 313 is connected to the adjustment board 31.

A connection device 40 has a connection board 41 which is connected to a side of the adjustment board 31 and a separation piece 42 is clamped between the connection board 41 and the adjustment board 31. The connection board 41 includes a first hole and a second hole. The shaft 22 extends through the first hole and positioned at the first hole by a C-clip 43. An axle 312 extends through the pivot hole 314 in the adjustment board 31 and the second hole in the connection board 41. The axle 312 is positioned at the second hole by another C-clip 44. The shaft 22 and the axle 312 are parallel to each other. The curve slot 311 and the fan-shaped adjustment board 31 has the same center at the pivot hole 314.

A resilient member 50 is connected between the connection board 41 and the adjustment board 31 so as to provide a force to pull the adjustment board 31 to its original position.

Figure 6:
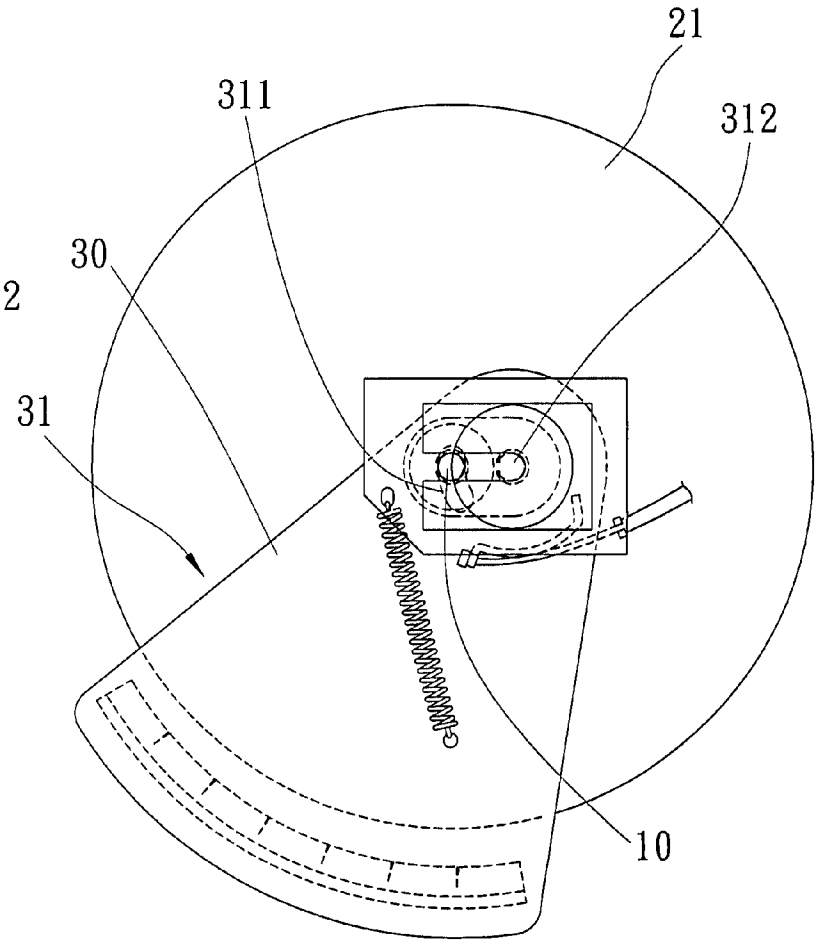
FIGS. 5 and 6 show that the gap between the magnet unit and the flywheel is adjusted.
Figure 5:
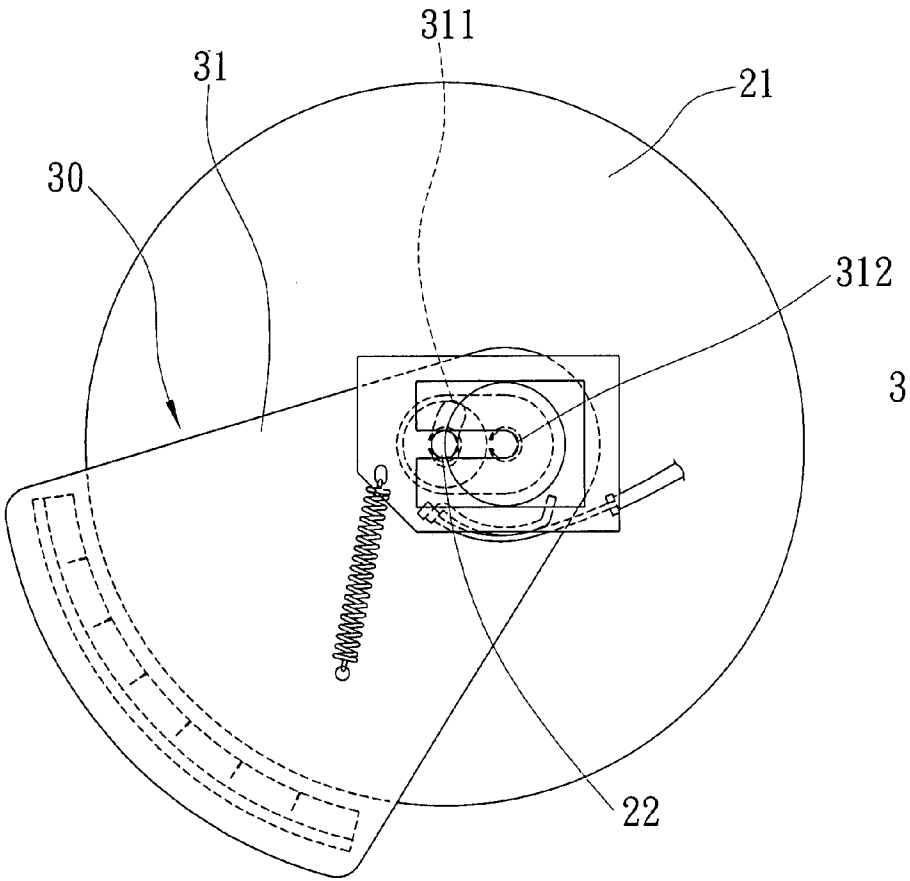
Figure 7:
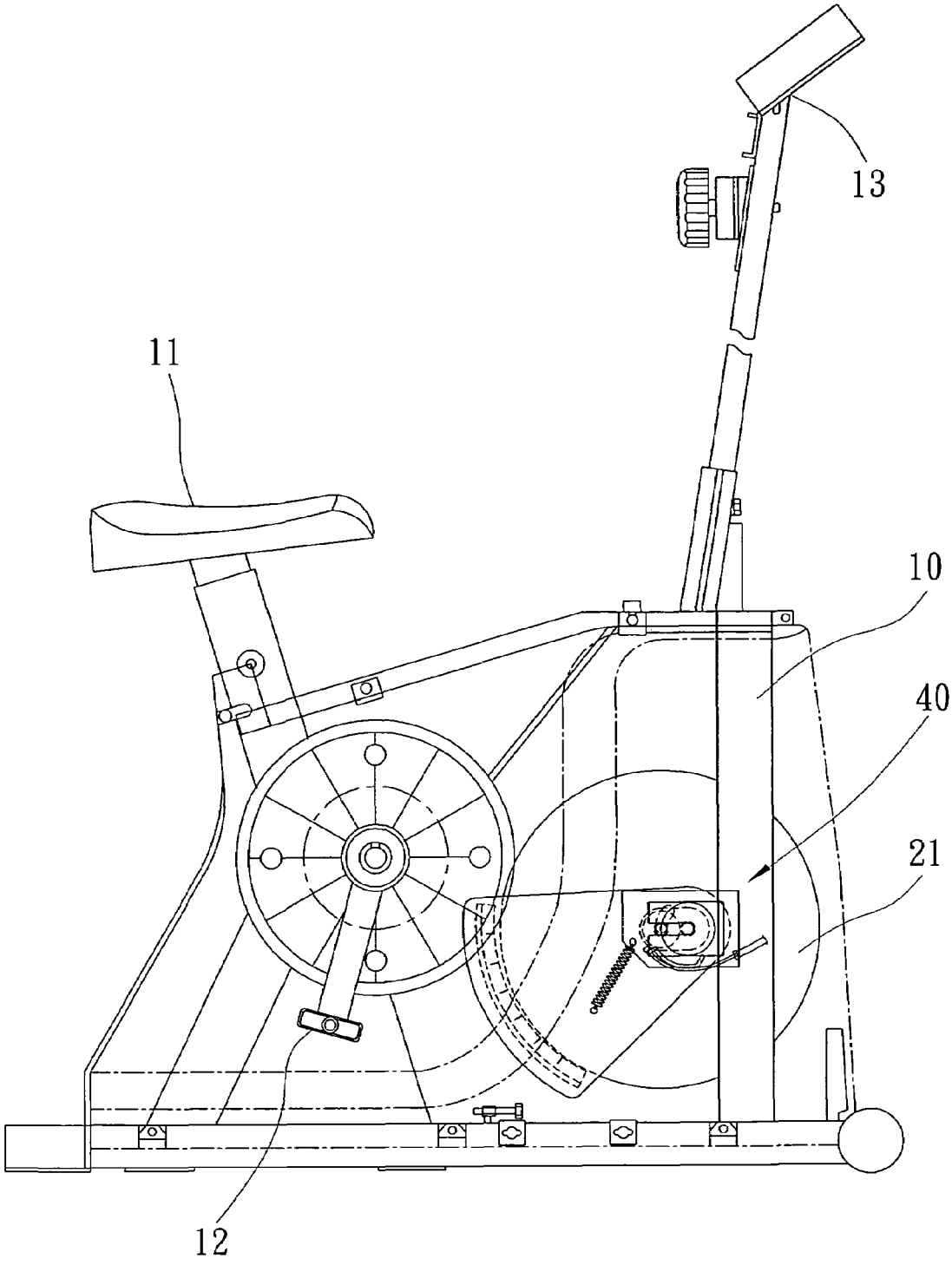
FIG. 7 shows a side view of an upright bike with the magnetic resistance mechanism of the present invention.

A control cable is connected to the wire connection member 313 on the adjustment board 31 so that the users may pull the control cable to pivot the adjustment board 31 which is pivoted about the axle 312 so as to adjust the gap between the magnet unit 32 and the flywheel 21 as shown in FIGS. 5 and 6.

While we have shown and described the embodiment in accordance with the present invention, it should be clear to those skilled in the art that further embodiments may be made without departing from the scope of the present invention.

What is claimed is:

1. A stationary exercise apparatus comprising:

an upright bicycle frame;

a flywheel mounted on a shaft extending through a center of the flywheel;

a magnetic resistance device having a fan-shaped adjustment board, a magnet unit, a wire connection member connected to the adjustment board, a curved slot and a pivot hole wherein the slot and hole are separately defined through the adjustment board; a connection board connected to the adjustment board; and a resilient member connected between the connection board and the adjustment board that biases the boards toward each other wherein the shaft also extends through the curved slot and a first hole in the connection board, an axle extends through the pivot hole and a second hole in the connection board and the axle and the shaft are disposed a distance from each other in parallel on two support plates which are connected to two upright posts of the bicycle frame such that a user can increase or decrease rotational resistance on the flywheel by adjustably pivoting the magnetic resistance device toward and away from a peripheral edge of the flywheel by manipulating the wire connection member to over come the bias of the resilient member.

2. The apparatus as claimed in claim 1, wherein a separation piece is clamped between the connection board and the adjustment board.

3. The apparatus as claimed in claim 1, wherein the two support plates each have a slot which is a horizontal slot.

4. The apparatus as claimed in claim 1, wherein each of the shaft and the axle are positioned at the connection board by two respective C-clips.

* * * * *